United States Patent [19]

Ivanoff et al.

[11] 4,084,924

[45] Apr. 18, 1978

[54] PUMP-MOTOR ASSEMBLAGE FOR CIRCULATING A COOLANT

[76] Inventors: Alexander Ivanoff, 20 Brookside Dr.; Victor Ivanoff, 30 Brookside Dr., both of Greenwich, Conn. 06830

[21] Appl. No.: 772,066

[22] Filed: Feb. 25, 1977

[51] Int. Cl.[2] ..... F04B 17/00; F04B 35/04

[52] U.S. Cl. ..... 417/424; 74/572; 74/574; 416/60

[58] Field of Search ..... 417/424, 373; 416/60; 74/572, 574

[56] References Cited

U.S. PATENT DOCUMENTS

| | | | |
|---|---|---|---|
| 691,667 | 1/1902 | Rowland | 74/574 UX |
| 3,022,433 | 2/1962 | Ferrant | 74/572 X |
| 3,960,034 | 6/1976 | Hintergräber | 416/60 X |

FOREIGN PATENT DOCUMENTS

| | | | |
|---|---|---|---|
| 970,307 | 9/1958 | Germany | 417/424 |

*Primary Examiner*—Carlton R. Croyle
*Assistant Examiner*—R. E. Gluck
*Attorney, Agent, or Firm*—Hane, Roberts, Spiecens & Cohen

[57] ABSTRACT

A motor-pump assemblage for circulating a coolant through a system requiring heat transfer has a motor casing filled with liquid and mounted on the motor drive shaft a flywheel keyed to the shaft and a free-wheeling shroud rotatable relative to the shaft and the flywheel. This shroud encompasses the flywheel but is spaced apart therefrom and includes passages for ingress and egress of liquid into the space between the flywheel and the shroud and out of this space.

10 Claims, 5 Drawing Figures

PUMP-MOTOR ASSEMBLAGE FOR CIRCULATING A COOLANT

The present invention relates to a pump-motor assemblage for circulating a coolant, and more particularly, for a pump-motor assemblage for circulating a coolant through a system in which heat transfer is required.

BACKGROUND OF THE INVENTION

There are known and used for the above-referred to purpose canned zero-leakage pumps. Such zero-leakage pumps have certain advantages over other types of pumps such as the absence of leakage and less maintenance. However, in systems such as installations in which heat transfer is required and crucial, certain important safety requirements may need to be provided. In the event that the pump motor stops, for instance due to power failure, dangerous temperature may occur in the system to be cooled by circulation of the coolant.

It is known and common practice to mount a flywheel keyed to the drive shaft of the pump motor. The purpose of such flywheel is to utilize the inertia of the flywheel to maintain the circulation of the coolant in case of power failure or breakdown of the motor for a period of time sufficient to stop the system to be cooled. Such arrangement presents no difficulties when a dry electric motor with a seal about its shaft is used. However, with a zero-leakage pump driven by a submersible motor in which both the pump and the drive motor are housed in the same pressure enclosure filled with the coolant to be circulated, it has been found that when a flywheel is mounted on the shaft of such motor the flywheel entails large consumption of the motor power due to the hydraulic drag friction as caused by rotation of the flywheel in the coolant such as water. This lowers the combined efficiency of the pump, motor and flywheel very considerably. As a result, the use of zero-leakage pumps in heat-transfer requiring systems in which continuous circulation of a coolant is crucial to avoid dangerous heat build-up has often been found to be unacceptable even though the use of such pumps would be highly desirable.

THE INVENTION

It is a broad object of the invention to provide in a zero-leakage pump assemblage including a coolant-filled motor for circulating the coolant such as water through a system requiring heat transfer, novel and improved means for maintaining upon break down or loss of power for the motor driving the pump circulation of the coolant for a period of time sufficient to stop operation of the system, thereby making said assemblage suitable for use in systems in which heat transfer occurs and dangerous heat release is generated a short time after stoppage of the circulation of the coolant.

A further object of the invention is to provide a novel and improved glandless or zero-leakage pump assemblage including means for maintaining circulation for an adequate period of time upon power failure or breakdown of the motor and appreciably reducing the increase in power consumption of the motor as is caused by mounting a flywheel on the drive shaft of the motor while the motor is in operation.

SUMMARY OF THE INVENTION

The aforepointed out objects, features and advantages, and other objects, features and advantages which will be pointed out hereinafter, are obtained by mounting on the same drive shaft as the flywheel a freewheeling shroud which encloses the flywheel, but spaced apart therefrom. As will be pointed out hereinafter, the shroud coacts with the flywheel so that the drag acting upon the flywheel and caused by the friction generated by the flywheel rotating within the liquid coolant is considerably reduced. As a result, the power consumption of the motor when and while driving the pump is also considerably reduced, thus correspondingly reducing the operational costs for driving the pump. As a result, it has become economically advantageous to use zero-leakage motor-pump assemblages.

BRIEF DESCRIPTION OF THE DRAWINGS

In the accompanying drawing, several preferred embodiments of the invention are shown by way of illustration and not by way of limitation.

IN THE DRAWING

Figure 1:
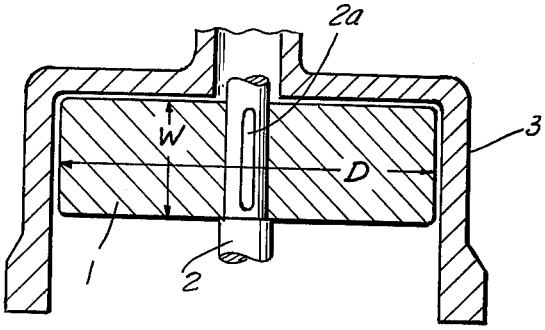
FIG. 1 PRIOR ART
Figure 3:
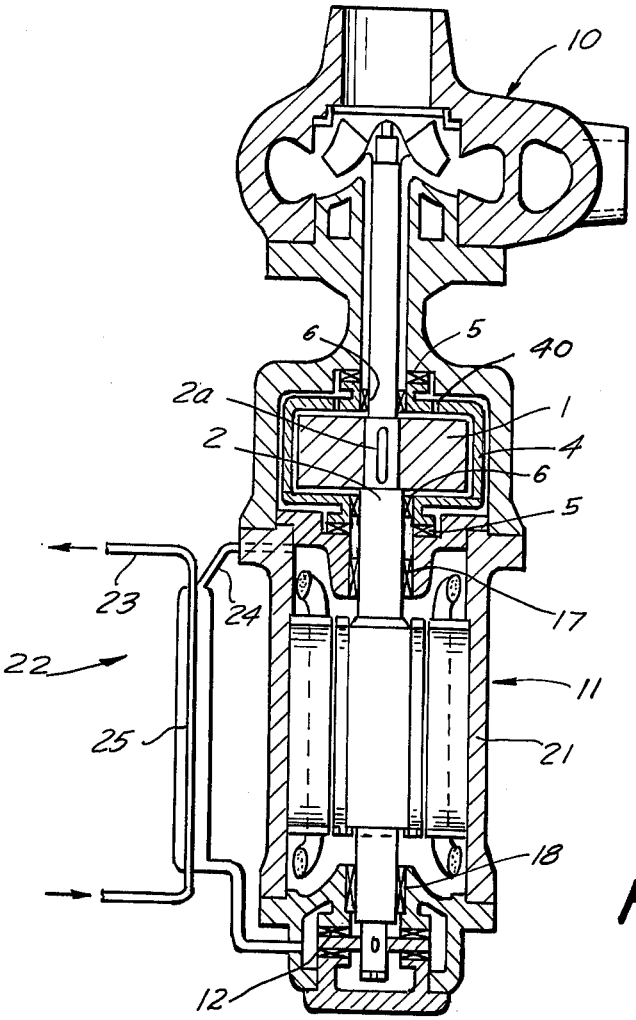
Figure 2:
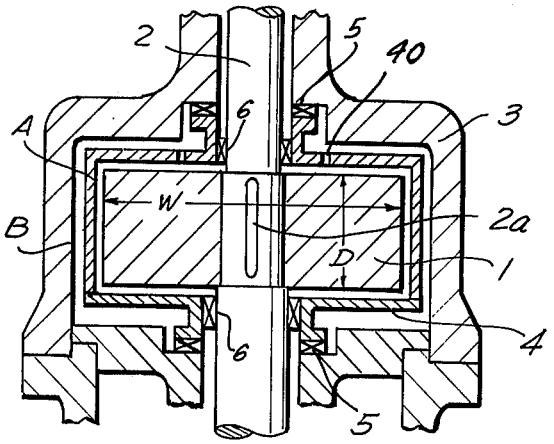
Figure 5:
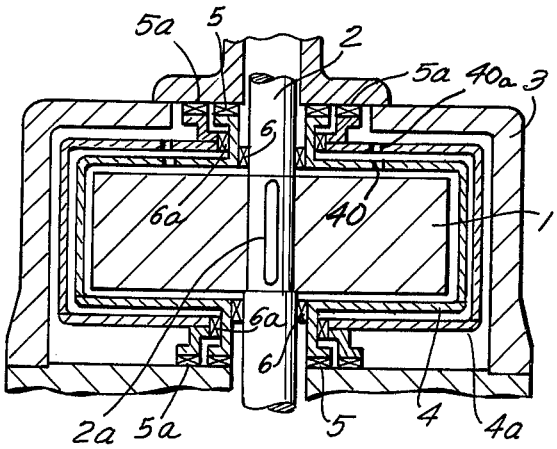
Figure 4:
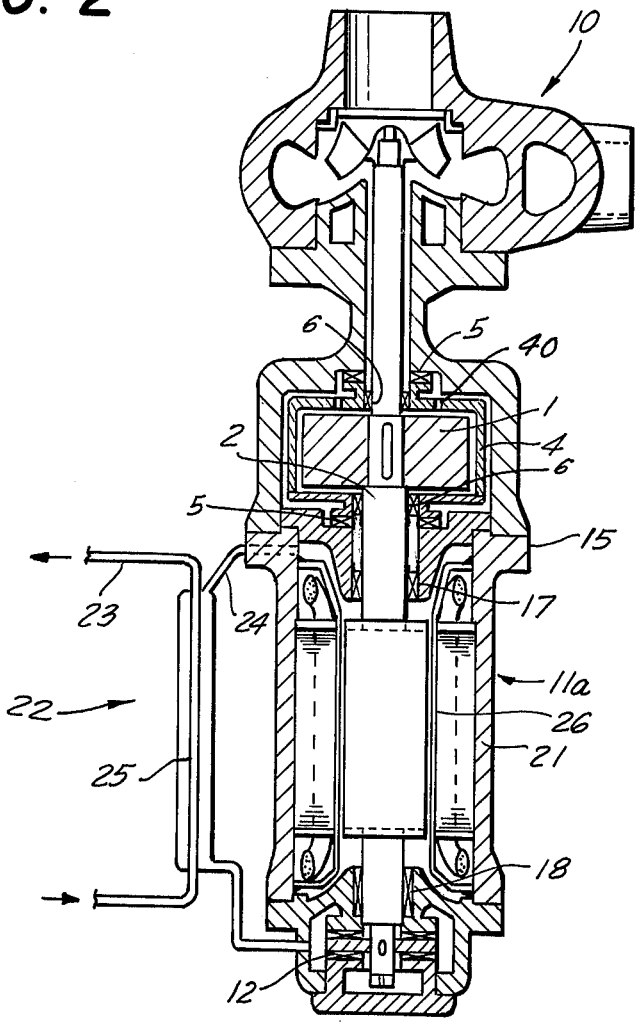

FIG. 1 is a prior art view of a fragmentary section of the drive shaft of the electric motor driving the pump of a pump assemblage as used for circulating a liquid coolant through an installation to be cooled and, more particularly, a system comprising heat transfer when and while in operation;

FIG. 2 is a sectional fragmentary view similar to FIG. 1, but showing a motor arrangement according to the invention;

FIG. 3 is an elevational sectional view of a wet stator zero-leakage pump assemblage according to the invention;

FIG. 4 is an elevational sectional view of a canned zero-leakage pump assemblage according to the invention; and FIG. 5 is a fragmentary sectional view similar to FIG. 2, but showing a modification of a motor arrangement according to the invention.

DETAILED DESCRIPTION OF THE DRAWING FIGURES

Referring now to the drawing figures more in detail, and first to prior art FIG. 1. This figure shows a flywheel 1 mounted on an extension of the shaft 2 of a combined pump-motor glandless unit (not shown), and is enclosed in a conventional watertight casing 3 of the unit. The flywheel is locked to the shaft by a key *2a*.

Referring now to FIG. 2, this figure shows a flywheel of the same diameter D and width W as the flywheel of FIG. 1. A freewheeling shroud 4 encloses the flywheel, but is not in contact with it or the casing 3. The shroud is preferably made of metal such as carbon steel or stainless steel, and includes means such as holes 40 to permit ingress and egress of coolant into the space A between the flywheel and shroud. This shroud is mounted on its own bearings, such as conventional radial bearings 6 and thrust bearings 5 fitted round the shaft or attached to the casing 3, thus enabling the shroud to rotate freely, actuated only by the swirl of the water serving as coolant. While the provision of bearings for the shroud is often preferable, the shroud can also be made to slide on the surface of the flywheel itself by means of a film of liquid inherently present between the shroud and the flywheel, thus providing the necessary lubrication and eliminating bearings.

As the flywheel 1 starts rotating, its drag will spin the liquid around it in the space A between the flywheel and the shroud and this spinning liquid will drag the shroud and cause it to free-wheel. The liquid in space B will exert a retarding torque on the outside of the shroud and the same will rotate at some intermediate speed, at which the accelerating torque due to the spinning liquid in inner space A will be equal to the retarding torque exerted by friction of the liquid in outer space B.

Under turbulent conditions in a liquid-filled casing such as casing 3, the horesepower lost by liquid friction on a solid body rotating with a liquid-filled casing is proportional to the cube of the relative angular velocity of the two surfaces. From this it follows that, if the angular velocity of the freewheeling shroud 4 is, for example, $\frac{1}{2}$ the angular velocity of the flywheel 1, then the horsepower expended in the liquid between the flywheel and the shroud will be reduced to $(\frac{1}{2})^3$, that is, to one-eighth of the horsepower expended in the liquid by an unshrouded flywheel. As the shroud is assumed to be revolving at half the angular velocity of the flywheel, the horsepower expended in the liquid outside the shroud also amounts to one-eighth of the horsepower expended by an unshrouded flywheel. Therefore, the total power expended by a shrouded flywheel is $\frac{1}{8} = \frac{1}{8} = \frac{1}{4}$ of the power expended by an unshrouded flywheel. For simplicity, in the above calculation there have been neglected the differences due to the fact that the external dimensions of the shroud are slightly greater than those of the flywheel.

The saving of power discussed above results in a considerable reduction of the total power consumption of the motor, and, therefore, in a reduction in the operating costs.

FIG. 3 shows a pump-motor assemblage according to the invention. The assemblage as shown in the figure is generally conventional except for the provision of shroud 4 including holes 40. The function of this freewheeling shroud is the same as has been explained in connection with FIG. 2. The shroud as shown in FIG. 3 is supported by radial bearings 6 and thrust bearings 5. As stated before, FIG. 2 shows the shroud 4 and its bearings 5 and 6 on an enlarged scale. Conventional bearings may be used for the purpose and are hence not described in detail. However, as previously described, the bearings may be omitted. The shaft 2 to which flywheel 1 is keyed, is driven by a motor 11 and is rotatably supported by conventional main motor bearings 17 and 18. At the bottom end of the motor there is provided a bearing 12, also of conventional design, which supports the motor shaft and any hydraulic end thrust due to the pump. The motor proper, the flywheel and the shroud are encased in a casing 21 which is filled with water or other suitable liquid.

The water within the casing is cooled by a conventional external heat exchanger 22 shown diagrammatically. The liquid filling the motor and warmed by the motor losses circulates through the heat exchanger along pipe 24. The lower pressure cooling water circulates through the heat exchanger along pipe 25 and out through pipe 23 and thus lowers the temperature of the liquid passing along pipe 24.

FIG. 4 also shows a pump-motor assemblage according to the invention which is similar to the motor-pump assemblage shown in FIG. 3. The same numerals designate the same components as are shown in FIG. 3. More specifically, the assemblage according to FIG. 4 is a canned zero-leakage pump-motor system. Accordingly, the motor 11*a* includes a can 26 made of a suitable thin sheet metal.

Since, as stated before, the general structure of the pump proper and the submersible motor are conventional, a more detailed description of the structural components of the pump proper and the motor driving the pump is not essential for the understanding of the invention.

Referring now to FIG. 5, this figure shows two shrouds 4 and 4*a* instead of the single shroud shown in FIGS. 2, 3 and 4. There are shown inner shroud 4 which encloses flywheel 1 and an outer shroud 4*a* which encloses shroud 4 and is so dimensioned that there is space between the inside of shroud 4*a* and the outside of shroud 4 and between the outside of the second shroud and the inside of casing 3. The inner shroud 4 is supported by radial bearings 6 and thrust bearings 5 and the second outer shroud is supported by radial bearings 6*a* and thrust bearings 5*a*. Various types of conventional bearings may be used for the purpose. Shroud 4*a* has holes 40*a*.

The two freewheeling shrouds rotate relative to each other and also relative to the flywheel, as previously described. Assuming that the size of the flywheel as has been defined in connection with FIG. 2 remains the same, the provision of the second shroud reduces the losses of motor power to a value in the order of 1/9 of the horsepower which would be required to drive an unshrouded flywheel.

A second shroud, or possibly more shrouds arranged as the two shrouds as shown in FIG. 5, can of course, also be used in the assemblages as shown in FIGS. 3 and 4, and similar types of pump-motor assemblages.

While the invention has been described in detail with respect to certain now preferred examples and embodiments of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A motor-pump assemblage for circulating a coolant through an installation requiring heat transfer, said motor-pump assemblage comprising:

a pump and an electric zero-leakage motor having an extended drive shaft operatively coupled to said pump;

a flywheel mounted on said shaft intermediate the pump and the motor rotationally locked to the shaft;

a freewheeling shroud encompassing said flywheel spaced apart therefrom and rotatable about said shaft and said flywheel, said shroud including passage means providing ingress and egress of liquid into and out of the space between the shroud and the flywheel; and a casing enclosing said motor, flywheel and shroud, said casing being filled with liquid.

2. The assemblage according to claim 1 and comprising bearings encompassing the shaft and supporting the shroud for freewheeling about the shaft and relative to the flywheel.

3. The assemblage according to claim 2 wherein said bearings comprise a radial bearing and a thrust bearing.

4. The assemblage according to claim 1 wherein said shroud is made of metal.

5. The assemblage according to claim 4 wherein said shroud is made of carbon steel.

6. The assemblage according to claim 4 wherein said shroud is made of stainless steel.

7. The assemblage according to claim 1 wherein said flywheel and said shroud are mounted on a shaft portion protruding from the motor but spaced apart from the pump.

8. The assemblage according to claim 1 and comprising at least a second freewheeling shroud enclosing the first shroud spaced apart therefrom, said second shroud being freewheeling relative to the shaft, the first shroud and the flywheel and including passage means for ingress and egress into and out of the space between the first shroud and the second shroud.

9. The assemblage according to claim 8 wherein said shrouds are supported by bearings for freewheeling about the flywheel and relative to each other.

10. The assemblage according to claim 9 wherein each of said shrouds is supported by radial bearings and thrust bearings encompassing said shaft.

* * * * *